United States Patent [19]

Bradley

[11] 4,321,948

[45] Mar. 30, 1982

[54] DISCHARGE SYSTEM FOR SEPTIC TANK

[76] Inventor: Earl H. Bradley, 920 County St., Seekonk, Mass. 02771

[21] Appl. No.: 227,177

[22] Filed: Jan. 22, 1981

[51] Int. Cl.[3] ..... F16K 21/18; E02B 13/00

[52] U.S. Cl. ..... 137/579; 137/396; 405/44

[58] Field of Search ..... 137/395, 396, 403, 236 R, 137/577, 579; 222/52, 56; 285/45; 405/39, 43, 44

[56] References Cited

U.S. PATENT DOCUMENTS

| | | | |
|---|---|---|---|
| 178,516 | 6/1876 | Duval | 137/579 |
| 228,264 | 6/1880 | McFarland | 137/396 |
| 444,564 | 1/1891 | Copeland | 405/39 |
| 625,239 | 5/1899 | Kruegor | 137/403 |
| 855,652 | 6/1907 | Mori | 405/43 |
| 921,513 | 5/1909 | Crawford | 137/236 |
| 1,641,881 | 9/1927 | DeLair | 137/579 |
| 1,644,532 | 10/1927 | Ledyard et al. | 210/109 |
| 2,307,324 | 1/1943 | Larson | 137/403 |
| 3,475,039 | 10/1969 | Ortloff | 285/45 |
| 3,946,762 | 3/1976 | Green | 138/140 |
| 4,081,374 | 3/1978 | Forshee | 210/116 |

FOREIGN PATENT DOCUMENTS

| | | | |
|---|---|---|---|
| 3815 | of 1912 | United Kingdom | 405/39 |

*Primary Examiner*—A. Michael Chambers
*Attorney, Agent, or Firm*—Barlow & Barlow

[57] ABSTRACT

A discharge system for a septic tank is disclosed which has a dump valve means at the outlet thereof for controlling the discharge of effluent. Leading from the dump valve is a central pipe that then has a plurality of smaller pipes interconnected therewith, the smaller pipes being interconnected so that the lower wall of the smaller pipes are in line with the lower wall of the larger pipe. Additionally, diverter valve or valve means as the case may be are provided for closing off part of the distribution system, and the distribution system itself is particularly characterized by having particular designed apertures through the lower circumferential section thereof so that the effluent will leach out of the pipes throughout their length by providing apertures at the far end of the pipe at the lower most circumferential portion and then progressively increasing the height of the holes as one goes back toward the central pipe and/or the septic tank.

5 Claims, 7 Drawing Figures

DISCHARGE SYSTEM FOR SEPTIC TANK

BACKGROUND OF THE INVENTION

Leaching fields for septic tanks have long been provided and generally consist of piping that leads directly from the discharge conduit of the septic tank possibly through a distribution box and thence out into a leaching field which consists essentially of synthetic pipe usually of a non-metallic nature which has lately been provided with a plurality of holes therein, which holes are more or less provided throughout the lower circumferential section of the pipe. As a result of this type of construction, generally when for example a water closet is flushed, the static level of a septic tank will rise approximately one-quarter of an inch. When this occurs, the effluent from the septic tank will flow out at a very slow rate since the volume in the septic tank has been increased by approximately six gallons. This amount of effluent is not enough to fill the pipes and accordingly, the effluent discharges into the leach field only through the first few holes in the perforated pipe. It will be apparent that with this type of system only the beginning portion of the leach field is being utilized and thus the leach field can readily become saturated, but only at the beginning of the leach field pipes. This occurs since certain suspended solids will be discharged into the leach field and there will be insufficient time for the bacterial action to act upon these solids with a constant addition of effluent. The preferred distribution system is one which is allowed to rest for a period of time so that the bacterial action will clear the field of any accumulated solids, and in this way there will be less clogging of the leaching field. This also will provide a proper further treatement of the effluent including the removal of pathogens which are effected through percolation through the soil.

SUMMARY OF THE INVENTION

A discharge system for a septic tank system is disclosed which provides good digestion throughout the leaching or drainage field. To achieve this, a dump or discharge valve means is provided at the outlet of the septic tank which holds liquid in the septic tank until it reaches a desired maximum level and then allows flow until the liquid in the tank reaches a desired minimum level. The dump valve is a portion of the discharge conduit of the septic tank with a pivoted tube attached to the outlet end of the discharge conduit. The pivoted tube is counterweighted with a counterweight arm, the arm being oriented with respect to the pivoted tube in such a way that when the pivoted tube is in the elevated position, or in an approximately 35° upward angle from the horizontal, the counterweight will exert a maximum force and yet when the pivoted tube drops to a discharge position, something on the order of 15° below the horizontal, the counterweight will change position so that the moment acting on the pivoted tube is reduced to at least 50 percent.

The tube will not therefore easily swing back to the shutoff position. The discharge from the pivoted tube then goes into a distribution system that is preferably a central pipe with a plurality of smaller pipes interconnected therewith by utilization of fittings that will permit the smaller pipe to be on the same level as the lower circumference of the larger central pipe. The smaller pipes which form the distribution and drainage field have apertures about the area defined principally by the lower circumference thereof and are arranged in such a way that near the terminus of each of the smaller pipes, the end aperture is at the bottom of the pipe as it lays in the trench and the other apertures that proceed toward the central pipe as viewed in a cross section will rise slightly from the bottom of the pipe to be finalized at an angle of approximately 60° as measured upwardly from a central bisector of the pipe section.

DESCRIPTION OF THE PREFERRED EMBODIMENT

Figure 1:
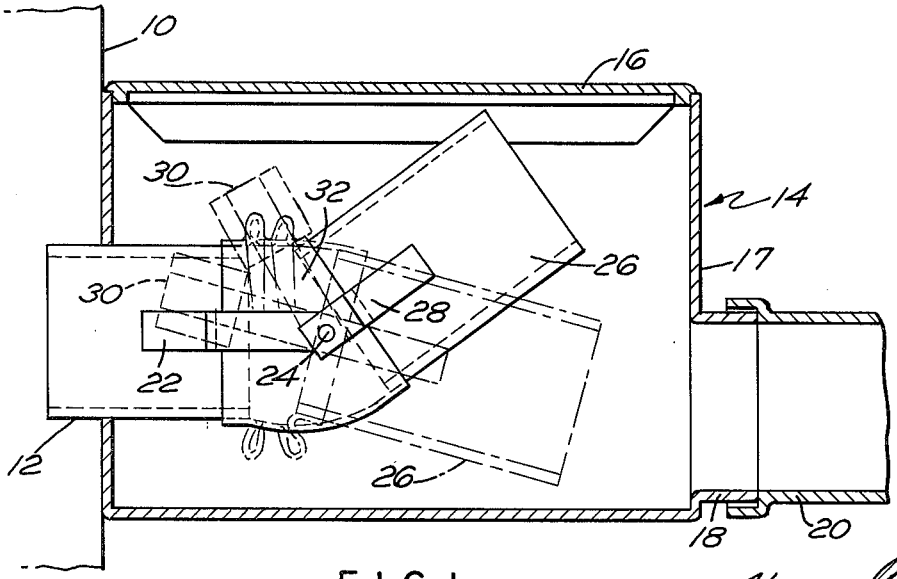
FIG. 1 is a vertical elevational view, partly in section, of a dump valve.
Figure 2:
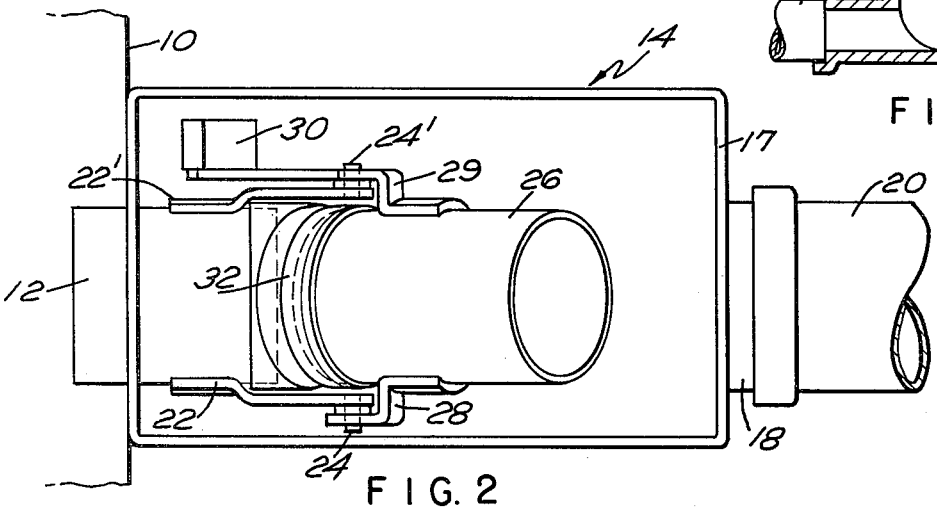
FIG. 2 is a top view of a dump valve with the cover removed.

Referring to FIG. 1, there is shown a wall of a septic tank designated 10 which is provided with a discharge conduit 12. Fitted over the discharge conduit is a dump valve box designated generally 14 which may be provided with a cover 16 so that access thereto may be readily had for repair. Fixed to the wall 17 of the box is an outlet conduit 18 which then may lead via a central pipe 20 to a drainage field system also known as a leach field. Attached to the conduit 20 are a pair of brackets 22, 22' which extend forwardly and have trunnions 24, 24' extending therefrom. A pivoted tube 26 has brackets 28, 29 attached thereto which brackets engage the trunnions 24, 24' respectively, the bracket 29 extending rearwardly to have mounted thereon a mass 30 (FIG. 2) that serves as a counterweight. Tube 26 is joined to the conduit 12 by a flexible boot 32 so that a liquid-tight seal is provided therebetween. As will be seen by referring to FIG. 1, the mass 30 when the tube 26 is in the up position as seen in solid lines will be in a position to exert a maximum torque on the tube 26, and when the tube is in the down position the force is applied at a shorter moment arm so as to reduce the torque thereon for a purpose which will be presently described.

It should be understood that the septic tank will discharge effluent through the conduit 12 as the level rises therein through the action of water being deposited in the septic tank. The arrangement is such that when the head rises sufficiently, enough water will accumulate in the tube 26 to overcome the moment of the mass 30. At that point in time, the tube 26 will pivot downwardly to the broken line position as seen in FIG. 1 and water will discharge out of the tank 10 until the head is reduced sufficiently, at which time the mass 30 will overcome the weight of the water being discharged down the tube and raise the tube again to the solid line position as seen in FIG. 1. This arrangement allows a pulsating distribution of water into the drainage field or distribution system with enough volume to flood the distribution pipes.

Figure 6:
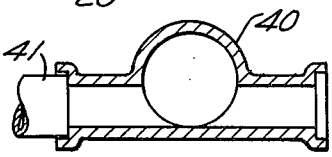
FIG. 6 is a section on lines 6—6 of FIG. 3.
Figure 3:
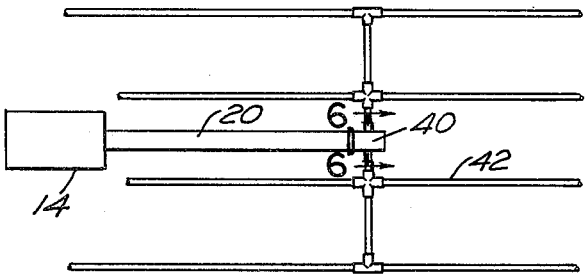
FIG. 3 is a schematical drawing of one form of a drainage field.
Figure 7:
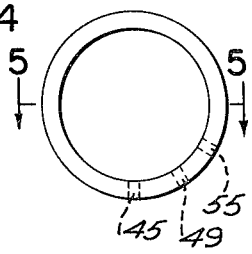
FIG. 7 is an end view showing the location of the apertures in FIG. 5.

Referring now to FIG. 3 of the drawings, one form of a distribution system has been diagrammed purely by way of example in which the conduit 20 is connected to a system of interconnected smaller pipes that may be arranged in any suitable fashion to suit the particular area in which leaching is desired. To achieve a proper interconnection of the main conduit 20 with the field it is preferred that a "T" 40 as seen in FIG. 6 be utilized. The "T" being particularly designed so that the smaller drainage field pipes such as 41 may be readily connected in a fashion whereby they will intercept the bottom of the main conduit. In addition, the drainage pipes such as 42 as seen in FIG. 3 are provided with apertures therein which vary in their position along the pipe. It should be assumed that at 44 there is a closed end of the pipe 42 and thus the first hole from the end of the pipe is at the bottom central portion thereof, seen as an aperture 45, with succeeding apertures toward the entrance of the pipe which will proceed upwardly along the side wall at a slow rate. As seen best in FIG. 7, apertures such as 46 preferably extend an angular distance upward of 13°, aperture 48 extending upward an amount of 23°, aperture 49 extending upward 32°, aperture 50 extending upward 40°, aperture 51 extending upward 45°, aperture 52 extending upward 50°, aperture 53 extending upward 54°, aperture 55 extending upward 58°, and aperture 56 extending upward 60°.

Figure 4:
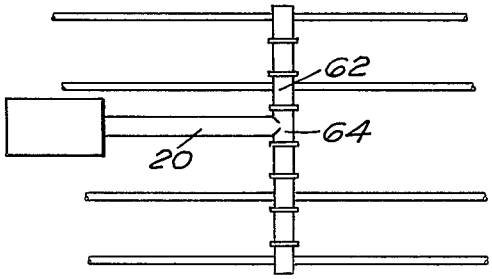
FIG. 4 is a schematic drawing of an alternate form of drainage field.
Figure 5:
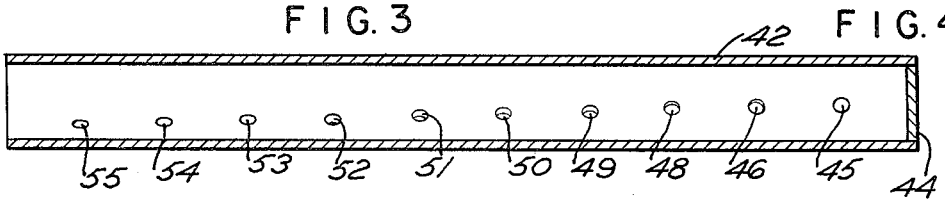
FIG. 5 is a sectional view of a preferred form of small pipe distribution taken on lines 5—5 of FIG. 7.

Other drainage field connections are possible as for example, it would be preferable to provide a valve such as a valve 64 in the drainage field of FIG. 4 so that on a periodic basis, a half of the drainage field can be activated and a half closed down. In this case, valve 64 is a diverter valve or "Y" valve. In this fashion, the same result can be achieved where half of the drainage field can be activated and the other half closed down for any particular period of time to provide the necessary bacterial action to take place to remove any of the discharge sludge that may occur in the field.

I claim:

1. A discharge system for a septic tank having a substantially horizontal discharge port comprising a conduit including a coupling lying substantially on the axis of and connected to said discharge port;

a tube coupled to the conduit coupling and having a free open outlet end;

tube pivot means whereby said tube pivots with relation to said conduit coupling so that the liquid in the tank flows into the tube to maintain the liquid in the tube at the level of the liquid in said tank;

means normally maintaining the outlet end of the tube in a raised position, yet allowing the tube to pivot downwardly when a predetermined head in the tank is reached whereby a rapid discharge is effected through said open end, the tube raising through action of said last named means when the head is insufficient to keep the tube in a down position, said means comprising an arm, a counter weight on said arm, said arm attached to the tube at such an angle to the tube axis that the torque tending to elevate the tube about said pivot means when the tube is in the elevated position is greater than when it is in the discharge position, and wherein the force is applied at a shorter moment arm when the tube is in the down position to permit delayed return to an elevated position and allow maximum discharge of the retained liquid wherein said weight is disposed on one side of the vertical axis passing through and perpendicular to the axis of the pivot means in both said elevated and discharge positions.

2. A discharge system for a septic tank as in claim 1 wherein the pivoted tube is coupled to the conduit coupling with a flexible joint.

3. A discharge system for a septic tank as in claim 1 including a central pipe means leading from said pivoting tube and a plurality of smaller pipes interconnected with the central pipe means at a position defined by its lower circumference, such pipes having apertures about the area defined by the lower circumference thereof.

4. A discharge system for a septic tank as in claim 3 wherein the central pipe means is provided with a valve means to divert the flow from one group of smaller pipes to another group.

5. A discharge system for a septic tank as in claim 3 wherein the apertures in the smaller pipes are located at varying positions about the lower circumference which positions vary progressively from a position at the bottom of the smaller pipes near the end thereof to a higher position through the wall of said pipe near the entrance thereof.

* * * * *

UNITED STATES PATENT OFFICE

CERTIFICATE OF CORRECTION

Patent No. 4,321,948 Dated March 30, 1982

Inventor(s) Earl H. Bradley

It is certified that error appears in the above-identified patent and that said Letters Patent are hereby corrected as shown below:

Column 2, line 36, change the numeral "20" to read --12--.

Signed and Sealed this

Twenty-seventh Day of July 1982

[SEAL]

Attest:

GERALD J. MOSSINGHOFF

Attesting Officer

Commissioner of Patents and Trademarks